US005643437A

United States Patent [19]

Dong et al.

[11] Patent Number: 5,643,437

[45] Date of Patent: Jul. 1, 1997

[54] CO-GENERATION OF AMMONIUM PERSULFATE ANODICALLY AND ALKALINE HYDROGEN PEROXIDE CATHODICALLY WITH CATHODE PRODUCTS RATIO CONTROL

[75] Inventors: Dennis F. Dong; Timothy Alan Mumby, both of Kingston, Canada; John R. Jackson, Wilmington, N.C.; Derek John Rogers, Kingston, Canada

[73] Assignee: Huron Tech Canada, Inc., Kingston, Canada

[21] Appl. No.: 553,018

[22] Filed: Nov. 3, 1995

[51] Int. Cl.[6] ..... C25B 1/30

[52] U.S. Cl. ..... 205/348; 205/349; 205/466; 205/468; 205/471; 205/552; 205/510; 204/265; 204/266; 204/290 F

[58] Field of Search ..... 205/348, 349, 205/465, 466, 468, 471, 552, 371, 367, 535; 204/265, 266, 290 F

[56] References Cited

U.S. PATENT DOCUMENTS

| | | | |
|---|---|---|---|
| 3,880,721 | 4/1975 | Littauer | 205/149 |
| 3,969,201 | 7/1976 | Oloman | 205/348 |
| 4,310,394 | 1/1982 | Malafosse | 205/471 |
| 4,384,931 | 5/1983 | Jasinski | 205/466 |
| 4,457,953 | 7/1984 | McIntyre | 427/113 |
| 4,482,440 | 11/1984 | Kadija | 205/412 |
| 4,626,326 | 12/1986 | Chiang | 205/347 |
| 5,082,543 | 1/1992 | Gnann et al. | 204/255 |

OTHER PUBLICATIONS

E. Berl, "A New Cathodic Process for the Production of H2O2", The Electrochemical Soc. Preprint 76–23 (1939) Sep. 1939.

Kalu et al., Journal Applied Electrochemistry 20 (1990) 932–940.

Tatapudi et al., J. Electrochem. Society vol. 140, No. 4, 55–57.

Wong et al., Pulp & Paper Canada 96:7 (1995) 236–238.

*Primary Examiner*—John Niebling
*Assistant Examiner*—Brendan Mee
*Attorney, Agent, or Firm*—Andrew E. Pierce

[57] ABSTRACT

An electrolytic cell and process for the cogeneration of a peroxy acid and salts thereof in an anolyte compartment of the cell and hydrogen peroxide at a desired ratio of an alkali metal hydroxide to hydrogen peroxide in the catholyte compartment of the cell. An ammonium compound is present as a reactant in the catholyte compartment. Ammonia is recycled from the catholyte compartment of the cell to the anolyte compartment of the cell or removed as a product.

11 Claims, No Drawings

CO-GENERATION OF AMMONIUM PERSULFATE ANODICALLY AND ALKALINE HYDROGEN PEROXIDE CATHODICALLY WITH CATHODE PRODUCTS RATIO CONTROL

BACKGROUND OF THE INVENTION

1. Field of the Invention

This invention relates to the cogeneration in an electrolytic cell of an alkaline hydrogen peroxide and an ammonium salt.

2. Description of Related Prior Art

Porous, packed bed, self-draining cathodes for use in electrolytic cells are known from Oloman et at., U.S. Pat. No. 3,969,201 and U.S. Pat. No. 4,118,305. Improvements in these cells have been disclosed by Mcintyre et al., in U.S. Pat. No. 4,406,758; U.S. Pat. No. 4,431,494; U.S. Pat. No. 4,445,986; U.S. Pat. No. 4,511,441; and U.S. Pat. No. 4,457,953. These electrolytic cells having packed bed cathodes are particularly useful for the production of alkaline solutions of hydrogen peroxide.

The simultaneous electrosynthesis of alkaline hydrogen peroxide and sodium chlorate is known from *Journal of Applied Electrochemistry,* 20 (1990) pages 932–940, Kalu et al. This reference discloses the production of an alkaline hydrogen peroxide produced by the electroreduction of oxygen in sodium hydroxide on a fixed carbon bed while cogenerating sodium chlorate at the anode.

In U.S. Pat. No. 5,082,543, Gnann et al. disclose the use of an electrolysis cell for the production of peroxy and perhalogenate compounds utilizing a high current density composite anode comprising a vane metal substrate and a platinum layer present thereon. The cathode is stainless steel.

SUMMARY OF THE INVENTION

The electrochemical cell of the filter press type and process disclosed are not only, particularly, suited for the cogeneration of an ammonium per-compound in the anolyte and alkaline hydrogen peroxide in the catholyte of the electrochemical cell but by combining the production of an ammonium compound from an acidic anolyte with the production of an alkaline hydrogen peroxide, it is possible to achieve a closed loop process for the generation of an alkaline hydrogen peroxide at a ratio of alkali metal hydroxide to hydrogen peroxide which is controllable to any desired level. In the electrochemical cell process of the invention, ammonium ions are removed as ammonia from the catholyte and recycled to the anolyte or removed as a product. If recycled, the ammonia has the effect of causing hydrogen ions to pass through a cation exchange permselective membrane cell separator into the catholyte, thus, neutralizing the alkalinity present therein as a function of the ammonia recycled to the anolyte. The anode is a discontinuous platinum group metal coating on a valve metal substrate. The cathode used in the electrochemical cell of the invention is a porous, self-draining electrode generally described in U.S. Pat. No. 4,457,953 in which the cathode is a fixed bed (sintered) porous matrix having a bed of loose particles of graphite coated with carbon and bonded with polytetrafluoroethylene. A particularly useful electrochemical cell process is the electrochemical cogeneration of ammonium persulfate anodically and an alkaline hydrogen peroxide cathodically from sulfuric acid and ammonium sulfate reactants.

DESCRIPTION OF THE PREFERRED EMBODIMENTS

In accordance with the invention, there is provided a novel electrolytic cell utilizing an anode operating at a high current density, said anode prepared by the discontinuous coating of a platinum group metal onto a valve metal substrate, preferably, a titanium or tantalum substrate. The anode is, preferably, prepared by cold rolling strips of platinum foil of about 5 to about 100 microns thickness onto a titanium tantalum, zirconium, or niobium sheet. Alternatively, the valve metal substrate can be coated overall, rather than discontinuously coated, and the coated titanium or tantalum substrate can be slit and expanded so as to obtain an electrode which is capable of operation at high current density. An expansion ratio of five to one is desirably achieved. This allows an anodic current density of about 5 to about 10 kA/m$^2$. A porous, self-draining cathode, generally, is utilized with a packed-bed thickness of about 0.1 to about 2.0 centimeters in the direction of current flow and comprises a composite of a fixed bed (sintered) porous matrix and a bed of loose particles, said electrode having pores of sufficient size and number to allow both gas and liquid to flow therethrough. The cathode, generally, contains particles of a conductive material which may also be a good electrocatalyst for the reaction to be carded out. In the reduction of oxygen to hydrogen peroxide, graphite particles coated with carbon and bound to the graphite with polytetrafluoroethylene as a binder have been found to be suitable for forming a cathode mass. The graphite is cheap, electrically conductive, and requires no special treatment for this use. The graphite particles, typically, have diameters in the range of about 0.005 to about 0.5 centimeters and have a minimum diameter of about 30 to about 50 microns. It is the bed of particles which act as the cathodes in the electrolytic cell of the invention.

The cation exchange permselective membrane utilized as a cell separator in the electrolytic cell of the invention can be a fluorocarbon polymer containing sulfonic groups. Illustrative of a useful cation-exchange membrane is a polyfluorocarbon resin which is a copolymer of tetrafluoroethylene with $$CF_2{=}CF{-}OCF_2CF_2SO_3H$$

or other corresponding acidic polymerizable fluorocarbon. Preferably, the polyfluorocarbon is at least one of a polymer of perfluorosulfonic acid, a polymer of perfluorocarboxylic acid, and copolymers thereof. These copolymers have equivalent weights of about 900 to about 1800 and are characterized by long fluorocarbon chains with various acidic groups including sulfonic, phosphonic, sulfuramide, or carboxylic groups or alkali metal salts of said groups attached thereto.

Illustrative of the cogeneration of ammonium persulfate salts anodically and hydrogen peroxide cathodically in the same electrolytic cell is the electrolysis of a mixture of sulfuric acid and ammonium sulfate as the anolyte. Generally, the anolyte contains an aqueous mixture of sulfuric acid and ammonium sulfate. A mixture of water or an aqueous solution of an alkali metal hydroxide and oxygen or an oxygen containing gas is passed to the top of the porous, self-draining cathode and this passes by gravity flow through the cathode. In operation, the anode current density is adjusted so that the ratio of anodic to cathodic current density is roughly 7.5. A typical anode current density is 0.78 Acm$^2$. The addition of water or an aqueous solution of an alkali metal hydroxide to the porous, self-draining cathode provides a desired alkalinity to peroxide weight ratio. Should the alkalinity to hydrogen peroxide weight ratio be higher than desired, an inert gas can be bubbled through the catholyte which may be withdrawn from the porous, self-draining cathode so as to allow the release of ammonium ion as ammonia and the recycling of ammonia to the anode compartment of the electrolytic cell. The addition of ammonia to the anolyte of the electrolytic cell results in the migration of hydrogen ions in the anolyte through the cationic permselective membrane to the catholyte which in affect reduces the alkalinity of the catholyte and changes the ratio of alkali metal hydroxide to hydrogen peroxide.

Chelating agents suitable for addition to the catholyte of the electrolytic cell of the invention are disclosed in U.S. Pat. No. 4,431,494, incorporated herein by reference. Such stabilizing agents against hydrogen peroxide decomposition include compounds that form chelates with metal impurities which act as catalysts for the decomposition of the hydrogen peroxide produced within the cell. Specific stabilizing agents include alkali metal salts of ethylenediamine tetraacidic acid, stanates, phosphates, alkali metal silicates, and 8-hydroxyquinoline.

In addition to the use of stabilizers in the catholyte against the decomposition of the hydrogen peroxide produced in the cathode compartment of the cell, it has been found desirable to add to the anolyte a small amount of thiocyanate ion, typically in the form of the ammonium thiocyanate in order to optimize current efficiency in the anolyte, thus, small amounts of ammonium thiocyanate are added up to about 500 parts per million to optimize current efficiency in the anolyte compartment of the cell.

The cell is operated at a temperature of about 10° to about 50° C. preferably, about 15° to about 25° C. Since the anode is operating at a high current density, there is a tendency for the need for cooling of the cell in order to optimize production of a compound, for instance ammonium persulfate, cogenerated in the anode compartment of the cell. The electrolytic production of ammonium persulfate is known to be promoted by the operation of the anode compartment at a temperature of about 5° C. to about 15° C. The operation of the anode compartment at lower temperatures may cause the compound produced to precipitate. However, the operation of the cell at excessively high temperatures will accelerate decomposition of both the product produced in the anode compartment as well as the hydrogen peroxide produced in the cathode compartment of the cell.

The electrochemistry associated with the cell of the invention can be summarized as follows where sulfuric acid and ammonium sulfate are electrolyzed in a cell utilized for the cogeneration of ammonium persulfate and an alkaline hydrogen peroxide. The main anode reactions are as follows:

$$2SO_4^{2-} \rightarrow S_2O_8^{2-} + 2e^- \quad \text{(I)}$$

$$2HSO_4 \rightarrow S_2O_8^{2-} + 2H^+ + 2e^- \quad \text{(II)}$$

The main cathode reactions are as follows:

$$O_2 + H_2O + 2e^- \rightarrow HO_2^- + OH^- \quad \text{(III)}$$

$$O_2 + 2H_2O + 4e^- \rightarrow 4OH^- \quad \text{(IV)}$$

The major current carriers are the ammonium ion and the hydrogen ion. These cations move from the anode compartment to the cathode compartment migrating through the cation exchange membrane.

The cation exchange membrane prevents anions from leaving the cathode compartment where a nominal alkalinity to peroxide ratio is obtained at 2:1 on a molar basis or 2.35:1 on a weight basis of the products sodium hydroxide/hydrogen peroxide. Such ratios arise because of the basic nature of the perhydroxyl ion which reacts to produce $OH^-$ ions according the following equilibrium:

$$HO^-_2 + H_2O \leftrightharpoons H_2O_2 + OH^- \quad \text{(V)}$$

However, in the cell of the invention some of this alkalinity is neutralized by hydrogen ions from the anolyte compartment so that weight ratios of less than 2.35:1 are possible.

For the equivalent of every two electrons of charge passed through the cell, two monovalent cations are produced. This requires that two cations pass through the membrane as counter ions. The cations available for passage through the cation exchange membrane are the ammonium ion and the hydrogen ion. The transport ratio of these two cations through the membrane will determine the ratio of alkalinity to hydrogen peroxide which theoretically will lie between 0 (all hydrogen ion) and 2.0 (all ammonium ion) on a molar basis assuming that no alkaline hydroxide addition is made and assuming that only water addition to the catholyte occurs and in addition, assuming a cathode current efficiency of 100 percent for peroxide production.

In accordance with the process of this invention, the alkalinity in the catholyte of the cell can be adjusted since in the presence of alkali metal hydroxide, the ammonium ion present in the catholyte is unstable in accordance with the following equilibria:

$$NH_4OH \leftrightharpoons NH_3\uparrow + H_2O \quad \text{(VI)}$$

$$NH_4OH \leftrightharpoons NH_4^+ + OH^- \quad \text{(VII)}$$

Accordingly, ammonia can be removed from the catholyte by bubbling an inert gas through the catholyte solution. This not only removes a toxic product from the alkaline peroxide solution, whose primary usefulness is found in the pulp mill bleaching process, but the removal of the ammonium ion as ammonia and the recycling of the ammonia back to the anolyte compartment of the electrolytic cell provides a mechanism for internally adjusting the catholyte so as to obtain a lower alkalinity to hydrogen peroxide ratio since adding ammonia to the anolyte of the electrolytic cell has a net result of transporting the hydrogen ion through the cation exchange permselective membrane into the catholyte.

In the following Examples there are illustrated the various aspects of the invention but these Examples are not intended to limit the scope of the invention. Where not otherwise specified in this specification and claims, temperature is in degrees centigrade and parts, percentages, and proportions are by weight.

EXAMPLE 1

A small electrochemical cell was constructed with the following characteristics. The anode used was a titanium plate with a thin strip of pure platinum pressed into the plate. The plate was 11 cm long, 2 cm wide and 0.48 cm thick. The platinum strip runs the length of the plate. The anolyte compartment is about 15 cm×4.5 cm×0.85 cm. The catholyte compartment is about 15 cm×2.5 cm×0.6 cm and is filled with composite chips consisting of high surface area carbon black (Vulcan XC72R) adhered to graphite chips (Union Carbide A65R) with Teflon (DuPont Teflon 30B). These chips are similar to those described in U.S. Pat. No. 4,457,953 for use in the reduction of oxygen to hydrogen peroxide in alkaline electrolytes. A capillary tube is lead into the top of the chip bed porous cathode to allow the addition of water or an aqueous sodium hydroxide solution from a feed reservoir. Oxygen gas is also added to the top of the chip bed in about a two times excess to that required for the reduction of oxygen to perhydroxyl ion and hydroxide ion. The anode and cathode are separated by Nation 417 a cationic ion exchange membrane.

The anolyte was recirculated through the anolyte compartment at about 200 $cm^3$/min. and consisted of sulphuric acid—$H_2SO_4$ (2.7M), ammonium sulphate—$(NH_4)_2SO_4$ (3.8M) and ammonium thiocyanate—$NH_4SCN$ (250 ppm). Oxygen gas was fed to the cathode chip bed at 80 $cm^3$/min. and 1M sodium hydroxide was fed at about 1 $cm^3$/min. Current was applied to the cell from a constant current source. The current was 4.0 A giving a current density of 0.76 A/$cm^2$ on the anode and 0.10 A/$cm^2$ on the cathode. Results are summarized below:

| | ANODE | CATHODE | CELL |
|---|---|---|---|
| Cell Voltage/Current (V/A) | — | — | 5.17/4.0 |
| Electrode Current Density (A/$cm^2$) | 0.76 | 0.10 | — |
| $(NH_4)_2S_2O_8$ conc. (gpl) | 20.6 | — | — |
| Anodic current efficiency (%) | 88.0 | — | — |
| Cathodic flow rate/catholyte NaOH conc. ($cm^3min^{-1}$/gpl) | — | 0.43/40 | — |
| Cathodic $H_2O_2$ conc. (gpl) | — | 45.3 | — |
| Cathodic current efficiency (%) | — | 46.5 | — |
| Cathodic NaOH/$H_2O_2$ weight ratio | — | 3.34 | — |

EXAMPLE 2

The same cell as that described in Example 1 was used. The anolyte concentration of ammonium persulphate had built up as the same anolyte feed used for Example 1 was utilized. The liquid catholyte feed was adjusted to be 5 gpl NaOH and in addition contained 0.002M ethylenediaminetetra-acetic acid (EDTA). This latter chemical was added to increase the cathodic current efficiency (as is taught in U.S. Pat. No. 4,431,494). The results are given below:

| | ANODE | CATHODE | CELL |
|---|---|---|---|
| Cell Voltage/current (V/A) | — | — | 5.11/4.03 |
| Electrode current density (A/$cm_2$) | 0.76 | 0.10 | — |
| $(NH_4)_2S_2O_8$ conc. (gpl) | 76.4 | — | — |
| Anodic current efficiency (%) | 99.4 | — | — |
| Cathodic flow rate/catholyte NaOH conc. ($cm^3$min./gpl) | — | 0.62/5.0 | — |
| Cathodic $H_2O_2$ conc. (gpl) | — | 53.4 | — |
| Cathodic current efficiency (%) | — | 77.3 | — |
| Cathodic NaOH/$H_2O_2$ weight ratio | — | 1.74 | — |

Examples 3 and 4 show how the catholyte NaOH to $H_2O_2$ product ratio can be adjusted by removing ammonia.

EXAMPLE 3

About 10 $cm^3$ of catholyte was taken from the cell with the concentrations noted in Example 2 above. The sample was placed in a test tube and argon bubbled through the solution at an estimated flow rate of 150 $cm^3$/min. for various periods of time. Samples were removed from the test tube periodically and the alkalinity and the hydrogen peroxide concentration determined. Results were as follows:

| Time argon bubbling (mins.) | $H_2O_2$ conc. (gpl) | Alkalinity, as NaOH (gpl) | NaOH/$H_2O_2$ weight ratio |
|---|---|---|---|
| 0 | 53.4 | 93.2 | 1.74 |
| 15 | 53.6 | 83.6 | 1.56 |
| 30 | 61.7 | 15.4 | 0.25 |

EXAMPLE 4

Another 10 $cm^3$ sample of catholyte was collected from the operating cell of Example 2. The sample was placed in a test tube and arranged so that helium gas was bubbled through the solution at 40 $cm^3$/min. Samples were removed periodically and analyzed for alkalinity (as NaOH) and hydrogen peroxide. The results are shown below:

| Time helium bubbling (mins.) | $H_2O_2$ conc. (gpl) | Alkalinity, as NaOH (gpl) | NaOH/$H_2O_2$ weight ratio |
|---|---|---|---|
| 0 | 65.7 | 122.2 | 1.86 |
| 60 | 62.6 | 82.8 | 1.32 |
| 120 | 59.9 | 63.0 | 1.05 |
| 150 | 59.6 | 54.4 | 0.91 |

While this invention has been described with reference to certain specific embodiments, it will be recognized by those skilled in this art that many variations are possible without departing from the scope and spirit of the invention, and it will be understood that it is intended to cover all changes and modifications of the invention disclosed herein for the purpose of illustration which do not constitute departures from the spirit and scope of the invention.

What is claimed is:

1. A closed loop electrolysis process for the cogeneration of an anode product in an anolyte of an electrolytic cell comprising:

conducting electrolysis utilizing an anode in an anode compartment containing an anolyte comprising an acid and an ammonium salt, cathodically reducing oxygen to produce hydrogen peroxide in an alkaline medium at a cathode in a cathode compartment containing a catholyte, and passing ammonium ions to said catholyte from said anolyte through a permselective cation exchange membrane wherein said anode product is generated at said anode and hydrogen peroxide is produced at a desired ratio of alkalinity to hydrogen peroxide by removal of ammonia from said catholyte.

2. The process of claim 1 wherein said anode is a discontinuous coating of a platinum group containing metal on a valve metal substrate and said cathode is a porous, self-draining cathode comprising a composite of a fixed bed porous matrix and a bed of loose particles of a high surface area carbon black adhered to graphite chips with a polytetrafluoroethylene binder.

3. The process of claim 2 wherein said anode consists of a strip of platinum or multiple strips of platinum on a titanium substrate and said anode product is an ammonium per-compound.

4. A closed loop process for the cogeneration in an electrolytic cell of an anode product at an anode in an anolyte compartment containing an anolyte comprising an acid and an ammonium salt and an alkaline hydrogen peroxide at a cathode in a catholyte compartment containing a catholyte, said anode and cathode separated by a permselective cation exchange membrane wherein ammonia is removed from said catholyte to produce a desired ratio of alkali metal hydroxide to hydrogen peroxide.

5. The process of claim 4 wherein said anode is operated at a high current density and said cathode comprises a porous, self-draining cathode.

6. The process of claim 5 wherein said anode consists of a discontinuous coating of a platinum group metal on a valve metal substrate and said anode product comprises an ammonium per-compound.

7. The process of claim 6 wherein said anode consists of a strip of platinum or multiple strips of platinum on a titanium substrate, said cathode is a composite chip bed comprising a high surface area carbon black adhered to graphite chips with polytetrafluoroethylene, and said anode product is ammonium persulfate.

8. An electrochemical cell for the cogeneration of an ammonium percompound at an anode in an anolyte compartment containing an anolyte and an alkaline hydrogen peroxide at an oxygen reduction cathode in a catholyte compartment containing a catholyte, said cell comprising:

an anode consisting of a discontinuous platinum group metal coating on a valve metal sheet substrate, a cation exchange permselective membrane separating said anode and said cathode, means for adding a mixture of oxygen or an oxygen containing gas and water or an aqueous solution of an alkali metal hydroxide to said cathode, means for removing ammonia from said catholyte, and means for recycling ammonia to the anolyte or removal as a product.

9. The electrochemical cell of claim 8 wherein said anode comprises a cold rolled platinum strip or multiple strips of platinum on a titanium substrate wherein said strips have a width which is twice the distance between said strips and said porous, self-draining cathode is a composite chip bed comprising a high surface area carbon black adhered to graphite chips with polytetrafluoroethylene.

10. The electrochemical cell of claim 9 wherein said platinum strips are cold rolled onto said titanium substrate utilizing a platinum foil having a thickness of about 5 to about 100 microns.

11. The electrochemical cell of claim 10 for the cogeneration at said anode of said cell of a peroxy acid and salts thereof wherein said cell has means for feeding reactants to the top of said catholyte and said electrolysis cell has means for withdrawing a catholyte solution from the base of said cathode.

* * * * *